US010209652B1

(12) United States Patent
Kikuchi et al.

(10) Patent No.: US 10,209,652 B1
(45) Date of Patent: Feb. 19, 2019

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Kazuhiko Kikuchi, Yokohama Kanagawa (JP); Sasuke Endo, Chigasaki Kanagawa (JP); Takaho Watanabe, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/667,795

(22) Filed: Aug. 3, 2017

(30) Foreign Application Priority Data

Apr. 21, 2017 (JP) ..... 2017-084731

(51) Int. Cl.

| | |
|---|---|
| ***G03G 15/20*** | (2006.01) |
| ***B65H 9/00*** | (2006.01) |
| ***B65H 9/04*** | (2006.01) |
| ***G03G 15/00*** | (2006.01) |
| ***B65H 7/20*** | (2006.01) |
| *B65H 5/06* | (2006.01) |

(52) U.S. Cl.
CPC ..... *G03G 15/2028* (2013.01); *B65H 7/20* (2013.01); *B65H 9/006* (2013.01); *B65H 9/04* (2013.01); *G03G 15/6573* (2013.01); *B65H 5/068* (2013.01); *G03G 2215/00561* (2013.01)

(58) Field of Classification Search
CPC ..... G03G 15/2028
See application file for complete search history.

(56) References Cited

U.S. PATENT DOCUMENTS 4,914,484 A * 4/1990 Kida ..... G03G 15/2003 219/216
5,373,354 A * 12/1994 Tadokoro ..... G03G 15/0131 399/127
5,749,040 A * 5/1998 Muramatsu ..... G03G 15/5062 399/389

(Continued)

OTHER PUBLICATIONS

Extended European Search Report for European Patent Application No. 18167166.0 dated Jul. 18, 2018.

*Primary Examiner* — Sevan A Aydin
(74) *Attorney, Agent, or Firm* — Amin, Turocy & Watson LLP

(57) ABSTRACT

An image forming apparatus comprises a transfer section, a fixing section, and a controller. The transfer section includes a transfer rotating body for conveying a sheet at a first linear velocity, and transfers a toner image onto the sheet. The fixing section forms a nip sandwiching the sheet with a first rotating body and a second rotating body, and a heating section for heating the sheet onto which the toner image is transferred. The controller executes a sheet acceleration and deceleration control for setting a linear velocity of the first rotating body to a second linear velocity from the first linear velocity before the tip of the sheet reaches the nip, and decelerating the linear velocity of the first rotating body from the second linear velocity to the first linear velocity at the time the tip of the sheet reaches a predetermined range in a sheet conveyance path.

20 Claims, 8 Drawing Sheets

(56) References Cited

U.S. PATENT DOCUMENTS

| | | | | |
|---|---|---|---|---|
| 6,909,857 | B2 * | 6/2005 | Tanaka | G03G 15/16 271/270 |
| 9,223,259 | B2 | 12/2015 | Hiroki et al. | |
| 9,329,538 | B2 | 5/2016 | Koda et al. | |
| 2009/0162121 | A1 * | 6/2009 | Kitan | G03G 15/657 399/400 |
| 2009/0208236 | A1 | 8/2009 | Katsura et al. | |
| 2010/0322681 | A1 * | 12/2010 | Kikuchi | G03G 15/2042 399/323 |
| 2015/0071667 | A1 * | 3/2015 | Hiroki | G03G 15/2014 399/68 |
| 2016/0018768 | A1 | 1/2016 | Kinouchi et al. | |
| 2017/0038714 | A1 | 2/2017 | Yamana et al. | |

* cited by examiner

IMAGE FORMING APPARATUS

CROSS-REFERENCE TO RELATED APPLICATIONS

This application is based upon and claims the benefit of priority from Japanese Patent Application No. 2017-084731, filed Apr. 21, 2017, the entire contents of which are incorporated herein by reference.

FIELD

Embodiments described herein relate generally to an image forming apparatus and methods related thereto.

BACKGROUND

Conventionally, an image forming apparatus includes a fixing section. For example, the fixing section has a heat roller (first rotating body) and a pressure roller (second rotating body). Between the heat roller and the pressure roller, a part that sandwiches a sheet becomes a nip. The heat roller heats a toner to fix it on the sheet.

Generally, in the sheet conveyance path, a gap such as a roller forming the nip is narrower than a gap of an upstream part along a conveyance path of the nip. Therefore, if a tip of the sheet reaches the nip along the sheet conveyance path, the sheet becomes difficult to move to a downstream side along the conveyance path and the movement of the sheet on the conveyance path temporarily stops. At this time, an effect of stopping the sheet is transmitted to the downstream side along the conveyance path, and there is a problem that a toner image transferred onto an upstream side end of the sheet is undesirably blurred.

DETAILED DESCRIPTION

In accordance with an embodiment, an image forming apparatus comprises a transfer section, a fixing section, and a controller. The transfer section includes a transfer rotating body for conveying a sheet at a first linear velocity, and transfers a toner image onto the sheet. The fixing section includes a first rotating body, a second rotating body facing the first rotating body to forma nip sandwiching the sheet with the first rotating body, and a heating section for heating the sheet onto which the toner image is transferred. The controller executes a sheet acceleration and deceleration control for setting a linear velocity of the first rotating body to a second linear velocity higher than the first linear velocity from the first linear velocity before the tip of the sheet reaches the nip, and starting decelerating the linear velocity of the first rotating body from the second linear velocity to the first linear velocity at the time the tip of the sheet reaches a predetermined range in a sheet conveyance path including an exit of the nip.

In accordance with another embodiment, an image forming method involves transferring a toner image onto a sheet; conveying the sheet using a transfer rotating body at a first linear velocity to a nip formed between a first rotating body and a second rotating body; heating the sheet onto which the toner image is transferred; accelerating the first rotating body to a second linear velocity from the first linear velocity before a tip of the sheet reaches the nip, the second linear velocity higher than the first linear velocity; and decelerating the first rotating body from the second linear velocity to the first linear velocity at a time the tip of the sheet reaches a predetermined range in a sheet conveyance path.

Hereafter, an image forming apparatus of an embodiment is described with reference to the accompanying drawings.

Figure 1:
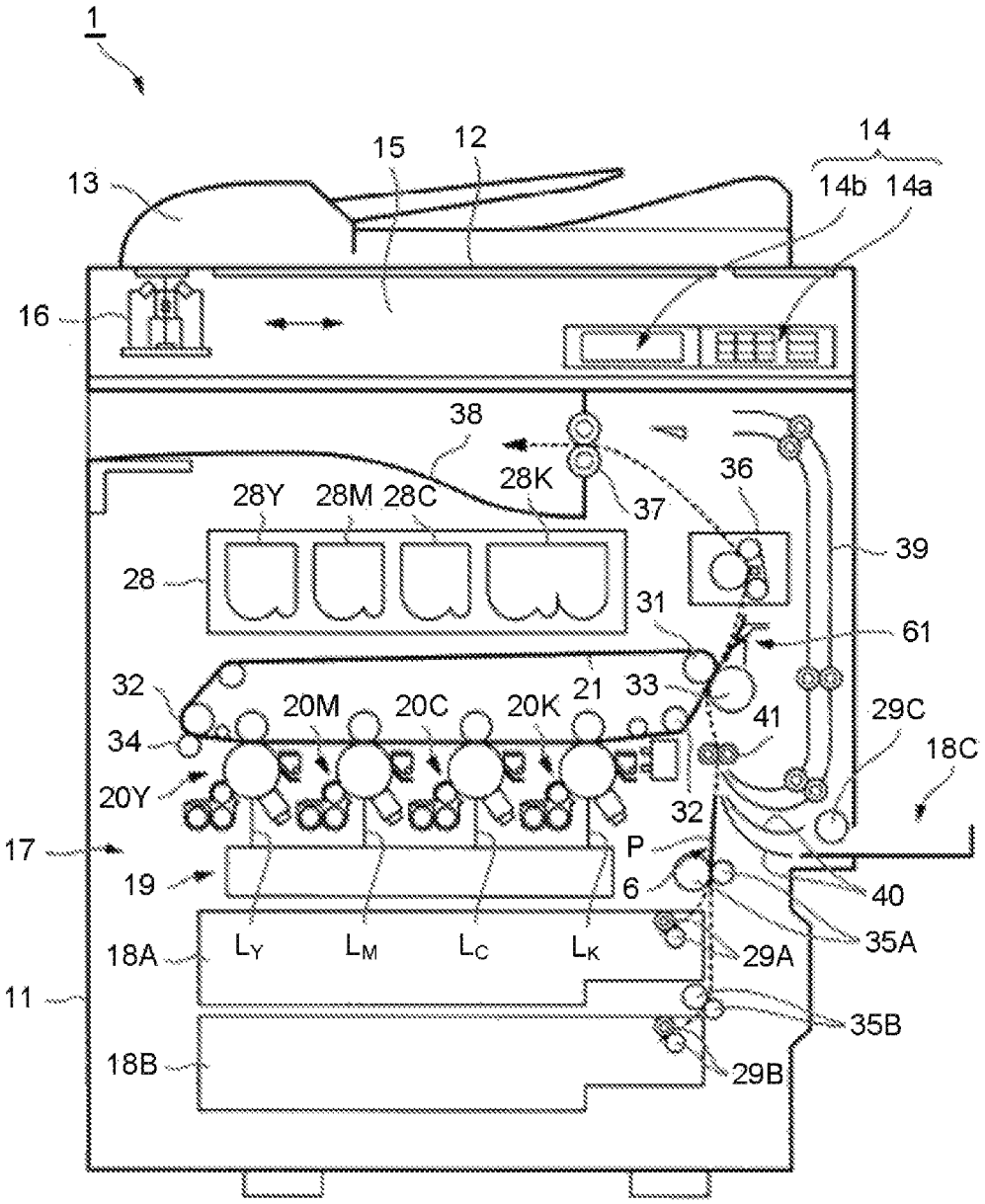
FIG. 1 is a schematic diagram of a cross section exemplifying the constitution of an image forming apparatus according to an embodiment.

As shown in FIG. 1, the image forming apparatus 1 of the present embodiment is, for example, an MFP (Multi-Function Peripherals), a printer, a copying machine, and the like. An example in which the image forming apparatus 1 is an MFP is described below.

The image forming apparatus 1 has a main body 11. At the top of the main body 11, a document table 12 including a transparent glass is provided. An automatic document feeder (ADF) 13 is provided on the document table 12. At the top of the main body 11, an operation section 14 is provided. The operation section 14 includes an operation panel 14*a* having various keys and a touch panel type operation and display section 14*b*.

A scanner section 15 is provided below the ADF 13. The scanner section 15 reads an original document sent by the ADF 13 or an original document placed on the document table 12. The scanner section 15 generates image data of the original document. For example, the scanner section 15 includes an image sensor 16. For example, the image sensor 16 may be a contact type image sensor.

The image sensor 16 moves along the document table 12 at the time of reading the image of the original document placed on the document table 12. The image sensor 16 reads an original document by each line for one page of the document image.

If the image of the original document sent by the ADF 13 is read, the image sensor 16 reads the sent original document at a fixed position shown in FIG. 1.

The main body 11 has a printer section (transfer section) 17 at a center in the height direction. The main body 11 has sheet feed cassettes 18A and 18B and a manual sheet feed unit 18C at the bottom.

The sheet feed cassettes 18A and 18B are arranged inside the main body 11. The sheet feed cassettes 18A and 18B are arranged to overlap in the order from the upper side to the lower side.

The manual sheet feed unit 18C protrudes to the side of the main body 11 below the conveyance path 39 described later.

The sheet feed cassettes 18A and 18B and the manual sheet feed unit 18C accommodate sheets P of various sizes. The sheet feed cassettes 18A and 18B and the manual sheet feed unit 18C accommodate the sheets P of various sizes in a central reference. The central axis in a conveyance orthogonal direction of each of the sheets P of various sizes which is a direction orthogonal to a conveyance direction of the sheet P along a conveyance surface of the sheet P is positioned at a fixed position.

As an example of the size of the sheet P, an A4 size (297 mm*210 mm) and an A3R size (297 mm*420 mm) are exemplified. A dimension inside the parenthesis indicates length in the conveyance orthogonal direction*length in the conveyance direction.

The different types of sheets P may be accommodated in the sheet feed cassettes 18A and 18B and the manual sheet feed unit 18C. As an example of the type of the sheet P, the type according to a thickness of the sheet P can be exemplified. For example, the sheet P is classified into "a plain sheet", "a thick sheet 1", "a thick sheet 2" and "a thick sheet 3" depending on basis weight (g/m$^2$) corresponding to the thickness of the sheet P. For example, the basis weight of "the plain sheet" is equal to or greater than 60 g/m$^2$ and equal to or smaller than 105 g/m$^2$. The basis weight of "the thick sheet 1" is equal to or greater than 106 g/m$^2$ and equal to or smaller than 163 g/m$^2$. The basis weight of "the thick sheet 2" is equal to or greater than 164 g/m$^2$ and equal to or smaller than 209 g/m$^2$. The basis weight of "the thick sheet 3" is equal to or greater than 210 g/m$^2$ and equal to or smaller than 256 g/m$^2$.

The type of the sheet P accommodated in the sheet feed cassettes 18A and 18B and the manual sheet feed unit 18C may be input through the operation panel 14*a* or the operation and display section 14*b*. The input type of the sheet P is notified to a system controller 72 described later.

For example, a case in which a sheet P which is the plain sheet of the A4 size is accommodated in the sheet feed cassette 18A, and a sheet P which is the thick sheet 2 of the A4 size is accommodated in the sheet feed cassette 18B is described below.

The sheet feed cassette 18A (18B) includes a sheet feed mechanism. 29A (29B). That the sheet feed cassette 18A (18B) has the sheet feed mechanism 29A (29B) includes both that the sheet feed cassette 18A has the sheet feed mechanism 29A and that the sheet feed cassette 18B has a sheet feed mechanism 29B. The same form is also used in the following description.

The sheet feed mechanism 29A (29B) picks up the sheets P one by one from the sheet feed cassette 18A (18B) and sends it to a conveyance path 6 of the sheet P. The conveyance path 6 is formed by rollers 31, 33, 35A, 35B and 41, a conveyance guide 40, a guide member 61 and is used to convey the sheet P. For example, the sheet feed mechanism 29A (29B) may include a pickup roller, a separation roller, and a sheet feed roller.

The manual sheet feed unit 18C has a manual sheet feed mechanism. 29C. The manual sheet feed mechanism 29C picks up the sheets P one by one from the manual sheet feed unit 18 C and sends it to the conveyance path 6.

The printer section 17 forms an image on the sheet P based on image data read by the scanner section 15 or image data created by a personal computer. The printer section 17 is a color printer of a tandem system.

The printer section 17 includes image forming sections 20Y, 20M, 20C and 20K of yellow (Y), magenta (M), cyan (C), and black (K) colors, an exposure device 19, and an intermediate transfer belt 21. In the present embodiment, the printer section 17 has four image forming sections 20Y, 20M, 20C and 20K. The printer section 17 has so-called quadruple image forming sections.

The constitution of the printer section 17 is not limited thereto, and the printer section may include two or three image forming sections, or the printer section may include five or more image forming sections.

The image forming sections 20Y, 20M, 20C and 20K are arranged under the intermediate transfer belt 21. The image forming sections 20Y, 20M, 20C and 20K are arranged in parallel along the downstream side from the upstream side in a moving direction (a direction from the left side to the right side in FIG. 1) of the lower side of the intermediate transfer belt 21.

The exposure device 19 irradiates exposure light LY, LM, LC and LK to the image forming sections 20Y, 20M, 20C and 20K, respectively.

The exposure device 19 may be constituted to generate a laser scanning beam as the exposure light. The exposure device 19 may include a solid-state scanning element such as an LED for generating the exposure light.

The constitutions of the image forming sections 20Y, 20M, 20C and 20K are common to each other except that the color of the toner is different. Either one of a normal color toner and a decoloring toner may be used as the toner. The decoloring toner becomes transparent if heated at a certain temperature or higher. The image forming apparatus 1 may be the image forming apparatus that can use the decoloring toner or the image forming apparatus that cannot use the decoloring toner.

Hereinafter, the constitution shared by the image forming sections 20Y, 20M, 20C and 20K is described by using the image forming section 20K as an example.

Figure 2:
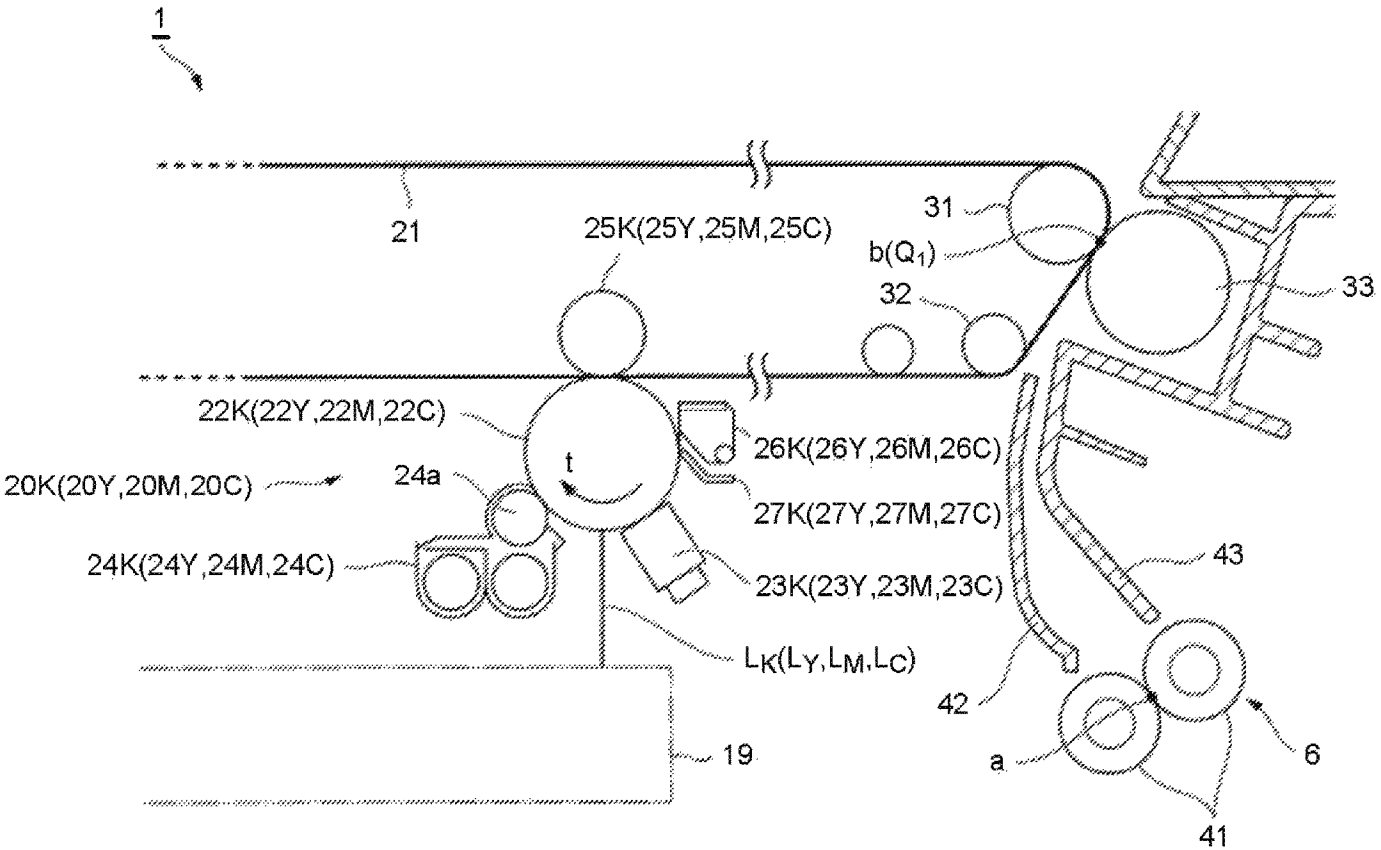
FIG. 2 is a schematic diagram of a cross section illustrating a part of the image forming apparatus according to an embodiment in an expanded manner.

As shown in FIG. 2, the image forming section 20K has a photoconductive drum 22K. The photoconductive drum 22K rotates in a rotation direction t. A charging device 23K, a developing device 24K, a primary transfer roller 25K and a cleaner 26K are arranged around the photoconductive drum 22K along the rotation direction t.

The charging section 23K of the image forming section 20K uniformly charges the surface of the photoconductive drum 22K.

The exposure device 19 generates the exposure light LK modulated based on the image data. The exposure light LK exposes the surface of the photoconductive drum 22K. The exposure device 19 forms an electrostatic latent image on the photoconductive drum 22K.

The developing device 24K supplies black toner to the photoconductive drum 22K by a developing roller 24*a* to which a developing bias is applied. The developing device 24K develops the electrostatic latent image on the photoconductive drum 22K.

The cleaner 26K has a blade 27K abutting against the photoconductive drum 22K. The blade 27K removes residual toner on the surface of the photoconductive drum 22K.

The image forming sections 20Y, 20M and 20C are provided with the photoconductive drums 22Y, 22M and 22C, charging devices 23Y, 23M and 23C, primary transfer rollers 25Y, 25M and 25C, cleaners 26Y, 26M and 26C, and blades 27Y, 27M and 27C which are similar to the photoconductive drum 22K, the charging device 23K, the primary transfer roller 25K, the cleaner 26K, and the blade 27K of the image forming section 20K.

The image forming sections 20Y, 20M and 20C have developing devices 24Y, 24M, and 24C differing only in the toner color from the developing device 24K of the image forming section 20K.

As shown in FIG. 1, at the top of the image forming sections 20Y, 20M, 20C and 20K, a supply section 28 is arranged.

The supply section 28 supplies toner to the developing devices 24Y, 24M, 24C and 24K, respectively. The supply section 28 has toner cartridges 28Y, 28M, 28C and 28K. The toner cartridges 28Y, 28M, 28C, and 28K store a yellow toner, a magenta toner, a cyan toner, and a black toner, respectively.

In each of the toner cartridges 28Y, 28M, 28C, and 28K, a marking part (not shown) is provided which is used for the main body 11 to detect the type of toner stored in each of the toner cartridges 28Y, 28M, 28C and 28K. The marking part includes at least information on the color of the toner in the toner cartridges 28Y, 28M, 28C and 28K and information for identifying whether it is the normal toner or the decoloring toner.

The intermediate transfer belt 21 moves cyclically. The intermediate transfer belt 21 is wrapped around the driving roller (transfer rotating body) 31 and a plurality of the driven rollers 32. The driving roller 31 rotates by a driving motor 77*a* described later to convey the sheet P at a first linear velocity which is a process linear velocity.

As shown in FIG. 2, the intermediate transfer belt 21 is in contact with the photoconductive drums 22Y, 22M, 22C and 22K from above.

At a position above the photoconductive drum 22K (22Y, 22M, 22C) and opposite to the photoconductive drum 22K (22Y, 22M, 22C) across the intermediate transfer belt 21, the primary transfer roller 25K (25Y, 25M, 25C) are arranged. The primary transfer roller 25K (25Y, 25M, 25C) is arranged inside the intermediate transfer belt 21.

If a primary transfer voltage is applied, the primary transfer roller 25K (25Y, 25M, 25C) primarily transfers the toner image on the photoconductive drum 22K (22Y, 22M, 22C) onto the intermediate transfer belt 21.

A secondary transfer roller 33 is opposed to the driving roller 31 across the intermediate transfer belt 21. The abutment portion between the intermediate transfer belt 21 and the secondary transfer roller 33 constitutes a secondary transfer position b. The driving roller 31 rotationally drives the intermediate transfer belt 21.

A secondary transfer voltage is applied to the secondary transfer roller 33 at the time the sheet P passes through the secondary transfer position b. If a secondary transfer voltage is applied to the secondary transfer roller 33, the secondary transfer roller 33 secondarily transfers the toner image on the intermediate transfer belt 21 to the sheet P. It is preferable that the driving roller 31 and the secondary transfer roller 33 rotate on the same plane.

Hereinafter, an exit where the driving roller 31 conveys the sheet P on the conveyance path 6 is referred to as a transfer exit Q1. The transfer exit Q1 is the same position (also including coinciding position) as the secondary transfer position b.

As shown in FIG. 1, a belt cleaner 34 is arranged at a position facing one of a plurality of the driven rollers 32 across the intermediate transfer belt 21. The belt cleaner 34 removes the residual transfer toner on the intermediate transfer belt 21 from the intermediate transfer belt 21.

A sheet feed roller 35A and a resist roller 41 are provided on the conveyance path 6 from the sheet feed cassette 18A to the secondary transfer roller 33. The sheet feed roller 35A conveys the sheet P taken out of the sheet feed cassette 18A by the sheet feed mechanism 29A.

The resist roller 41 aligns the tip of the sheet P fed from the sheet feed roller 35A at a mutual contact position thereof. The mutual contact position in the resist roller 41 (refer to point a in FIG. 2) constitutes a resist position. If the tip of the toner image reaches the secondary transfer position b, the resist roller 41 conveys the sheet P such that the tip of a transfer area of the toner image on the sheet P reaches the secondary transfer position b. The transfer area of the toner image is a region excluding the formation area with blank edge on the sheet P.

As shown in FIG. 2, between the resist roller 41 and the intermediate transfer belt 21, conveyance guides 42 and 43 for guiding the conveyance of the sheet P are arranged. The conveyance guide 42 guides a front surface onto which the toner image is transferred of the sheet P. The conveyance guide 43 guides a back side of the front surface to which the toner image is transferred of the sheet P. Between the lower ends of the conveyance guides 42 and 43, there is formed an entrance opening facing the resist position a in the resist roller 41. Between the upper ends of the conveyance guides 42 and 43, an exit opening through which the sheet P can be inserted is formed. The exit opening opens at a position facing the intermediate transfer belt 21 stretched by the driving roller 31 and the driven roller 32 below the driving roller 31.

As shown in FIG. 1, a sheet feed roller 35B is provided on the conveyance path 6 from the sheet feed cassette 18B to the sheet feed roller 35A. The sheet feed roller 35B conveys the sheet P taken out of the sheet feed cassette 18B by the sheet feed mechanism 29B towards the sheet feed roller 35A.

The conveyance path 6 is formed by the conveyance guide 40 between the manual sheet feed mechanism 29C and the resist roller 41. The manual sheet feed mechanism 29C conveys the sheet P taken out of the manual sheet feed unit 18C toward the conveyance guide 40. The sheet P moving along the conveyance guide 40 reaches the resist roller 41.

At the downstream side (upper side in the figure) of the secondary transfer roller 33 in the conveyance direction of the sheet P, a fixing device (fixing section) 36 is arranged.

A conveyance roller 37 is arranged at the downstream side (upper left side in the figure) of the fixing device 36 in the conveyance direction of the sheet P. the conveyance roller 37 discharges the sheet P to a sheet discharge section 38.

An inversion conveyance path 39 is arranged at the downstream side (right side in the figure) of the fixing device 36 in the conveyance direction of the sheet P. The inversion conveyance path 39 reverses the sheet P to guide it to the secondary transfer roller 33. The inversion conveyance path 39 is used for duplex printing.

The fixing device 36 is described in detail.

Figure 3:
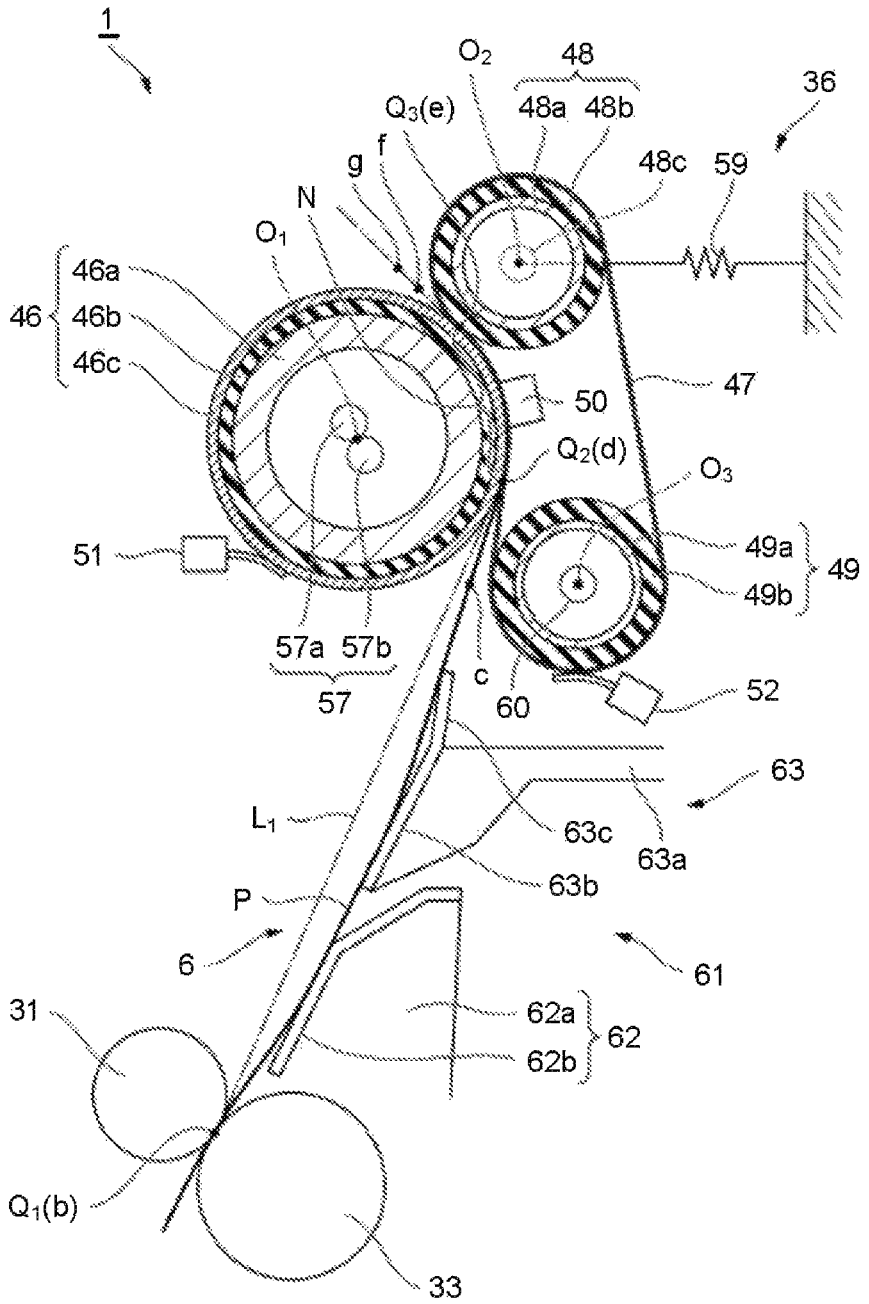
FIG. 3 is a schematic diagram of a cross section exemplifying the constitution of main sections of a fixing device in the image forming apparatus according to the embodiment.

FIG. 3 is a schematic diagram of a cross section exemplifying the constitution of main sections of the fixing device 36 according to the embodiment.

The fixing device 36 includes a heat roller (first rotating body) 46, a fixing belt (second rotating body) 47, a pressure roller 48, a belt heat roller 49, a pad 50 and thermistors 51 and 52.

The heat roller 46 has a core metal 46*a*, an elastic layer 46*b*, and a release layer 46*c*.

The core metal 46*a* is a cylindrical member made of metal. For example, the core metal 46*a* may be made of an aluminum alloy having heat resistance. For example, a thickness of the core metal 46*a* is 0.9 mm.

Both ends of the core metal 46*a* are supported by supporting members (not shown) in the fixing device 36 via bearings (not shown). The core metal 46*a* extends along a central axis O1 of the heat roller 46. The central axis O1 extends in a depth direction (conveyance orthogonal direction) in FIG. 3. The core metal 46*a* is rotatable around the central axis O1. At the end of the core metal 46*a* in an axial direction, a gear (not shown) is provided. The gear transmits a rotation driving force to the heat roller 46. The rotation driving force transmitted by the gear is generated by a driving motor 55 (refer to FIG. 4). The rotation driving force generated by the driving motor 55 is transmitted to the gear via a transmission mechanism (not shown) connected to the driving motor 55.

The type of the driving motor 55 is not particularly limited as long as a speed control can be made. For the example, the driving motor 55 may be a DC brushless motor, a pulse motor, an ultrasonic motor, or the like.

If the rotation driving force is transmitted to the gear, the heat roller 46 rotates counterclockwise shown in FIG. 3 around the central axis O1.

As shown in FIG. 3, the elastic layer 46*b* is laminated on an outer peripheral surface of the core metal 46*a*. The elastic layer 46*b* is formed in a wider range than a sheet passing area of the sheet P in the conveyance orthogonal direction. For example, the elastic layer 46*b* is formed of a heat-resistant rubber material. The elastic layer 46*b* may be formed of silicone rubber. For example, a thickness of the elastic layer 46*b* is 200 μm (micrometer).

The release layer 46*c* is laminated on the outer peripheral surface of the elastic layer 46*b*. The release layer 46*c* is formed of a resin material having good releasability with respect to the toner such as fluororesin. As an example of a suitable material for the release layer 46*c*, conductive PFA (polytetrafluoroethylene) is exemplified. For example, the thickness of the release layer 46*c* is 50 μm.

For the example, the heat roller 46 has an outer diameter of 40 mm.

The outer surface of the heat roller 46 is formed in an inverted crown shape at least in a range of the sheet passing area of the sheet Pin the conveyance orthogonal direction. The inverted crown shape referred to here is a shape in which an outer diameter is gradually enlarged from the center to both ends in the axial direction. A difference (hereinafter, referred to as a reverse crown amount) between the maximum diameter and the minimum diameter of the reverse crown shape in the heat roller 46 may be 100 μm.

The reverse crown shape in the heat roller 46 may be formed by changing the thickness of at least one of the core metal 46*a* and the elastic layer 46*b*.

Inside the heat roller 46, halogen lamps 57*a* and 57*b* which are the heating section 57 are inserted. Both ends of the halogen lamps 57*a* and 57*b* protrude to the outside of the core metal 46*a* of the heat roller 46, respectively. Both ends of the halogen lamps 57*a* and 57*b* are supported by a lamp holder (not shown) in the fixing device 36.

The halogen lamps 57*a* and 57*b* heat the sheet P onto which the toner image is transferred via the heat roller 46.

The fixing belt 47 is an endless belt. A width (length of the conveyance orthogonal direction) of the fixing belt 47 is wider than the maximum width of the sheet P that can be passed. The fixing belt 47 is made of a heat-resistant material resistant to heating by the heat roller 46. Fluororesin may be laminated on the outer peripheral surface of the fixing belt 47.

For example, the fixing belt 47 may be made of a polyimide base material of which the outer circumferential surface is covered with a PFA tube. For example, the thickness of the polyimide base material may be equal to or greater than 60 μm and equal to or smaller than 70 μm.

The fixing belt 47 is wrapped around two rollers 48 and 49 at the inner peripheral surface. The fixing belt 47 is wrapped around a part of the heat roller 46 at the outer peripheral surface. The fixing belt 47 faces the heat roller 46. The term "facing" referred to herein includes a contact state.

The number of rollers through which the fixing belt 47 is wound is not limited to two and may be three or more.

The portion where the heat roller 46 and the fixing belt 47 contact if the sheet P is not interposed forms a nip N sandwiching the sheet P between the heat roller 46 and the fixing belt 47. The nip N is curved along the outer peripheral surface of the heat roller 46 if viewed along the central axis O1 of the heat roller 46. The length of the nip N in the conveyance orthogonal direction is longer than that of the sheet passing area of the sheet Pin the conveyance orthogonal direction. The width of the nip N (hereinafter, referred to as a nip width) along the circumferential direction of the heat roller 46 is determined according to an amount of heat required for thermal fixing of the toner image transferred onto the sheet P.

Hereinafter, an upstream side end of the nip N in the conveyance direction of the sheet P along the conveyance path 6 of the sheet P is referred to as an entrance Q2 of the nip N in some cases. A downstream side end of the nip N in the conveyance direction of the sheet P along the conveyance path 6 of the sheet P is referred to as an exit Q3 of the nip N.

The pressure roller 48 and the belt heat roller 49 are arranged inside the fixing belt 47. The pressure roller 48 and the belt heat roller 49 apply tension to the fixing belt 47. The belt heat roller 49 and the pressure roller 48 are arranged in the order along the conveyance direction of the sheet P in the fixing device 36.

The belt heat roller 49 is located closer to the driving roller 31 than the pressure roller 48. The belt heat roller 49 and the pressure roller 48 are apart from each other.

The pressure roller 48 is arranged above the central axis 01 of the heat roller 46 and is arranged to face the heat roller 46 across the fixing belt 47. The pressure roller 48 presses the heat roller 46 across the fixing belt 47. Between the pressure roller 48 and the belt heat roller 49, a part of the fixing belt 47 facing the heat roller 46 is wrapped around the heat roller 46.

The pressure roller 48 has a core metal 48*a* and an elastic layer 48*b*.

The core metal 48*a* is made of metal. A rotation axis 48*c* extends at both ends of the core metal 48*a*. The rotation axis 48*c* is coaxial with a central axis O2. The rotation axis 48*c* is supported by a supporting member (not shown) in the fixing device 36 via a bearing (not shown). The rotation axis 48*c* is rotatable around the central axis O2.

The elastic layer 48*b* is laminated on the outer peripheral surface of the core metal 48*a*. The elastic layer 48*b* may be composed of a rubber layer. The elastic layer 48*b* may be composed of a silicon rubber layer or the like. For example, the thickness of the elastic layer 48*b* is 2 mm. For example, the pressure roller 48 has an outer diameter of 21 mm.

The outer circumferential surface of the pressure roller 48 is formed into a normal crown shape in at least the range of the sheet passing area of the sheet P in the conveyance orthogonal direction. The normal crown shape referred to here is a shape in which an outer diameter gradually decreases from the center to both ends in the axial direction. A difference (hereinafter, referred to as a normal crown amount) between the maximum diameter and the minimum diameter of the normal crown shape in the pressure roller 48 is determined so that a pressure distribution at the contact part becomes appropriate according to the reverse crown amount of the heat roller 46. For example, in the case of corresponding to the reverse crown amount of 100 μm in the specific dimension example of the heat roller 46 described above, the normal crown amount of the pressure roller 48 may be set to 680 μm.

By making the pressure roller 48 to the normal crown shape, it is possible to suppress the fixing belt 47 from approaching the conveyance orthogonal direction.

The pressure roller 48 is pressed from the right side to the left side in FIG. 3 by a pressing spring 59. The pressing spring 59 is fixed to a supporting member whose reference numeral is omitted in the fixing device 36. The pressure spring 59 applies tension to the fixing belt 47. In addition, the pressure spring 59 presses the pressure roller 48 against the heat roller 46.

The belt heat roller 49 has a core metal 49*a* made of metal. A halogen lamp 60 is inserted in the core metal 49*a*. The halogen lamp 60 heats the fixing belt 47 via the core metal 49*a*.

On the outer peripheral surface of the core metal 49*a*, an elastic layer 49*b* may be laminated. In this case, the surface layer of the halogen lamp 60 may be coated with a material having a good releasability. For example, a PFA coat or the like is used for coating.

The belt heat roller 49 is supported by a supporting member (not shown) in the fixing device 36 via a bearing (not shown). The belt heat roller 49 is rotatable around a central axis O3 extending in the depth direction (conveyance orthogonal direction) in FIG. 3.

The belt heat roller 49 may be pressed by a tension spring (not shown). The belt heat roller 49 may apply the tension to the fixing belt 47 by being pressed against the tension spring. However, in the present embodiment, as an example, the position of the central axis O3 of the belt heat roller 49 is fixed with respect to the supporting member of the fixing device 36.

The heat roller 46, the fixing belt 47, the pressure roller 48, and the belt heat roller 49 preferably rotate on the same plane. The same plane is preferably parallel to the aforementioned plane in which the driving roller 31 and the secondary transfer roller 33 rotate.

The pad 50 is located inside the fixing belt 47. The pad 50 is located between the pressure roller 48 and the belt heat roller 49 and opposite the heat roller 46 across the fixing belt 47. The pad 50 is pressurized toward the fixing belt 47 by a spring (not shown).

By using the pad 50, the nip width stabilizes.

The fixing belt 47, the pressure roller 48, and the belt heat roller 49 rotate by the rotation of the heat roller 46 by the driving motor 77*a* described later. The driving motor 77*a* for rotating the heat roller 46 and the driving motor 77*a* mentioned above for rotating the driving roller 31 are mutually different driving motors 77*a*.

The thermistor 51 abuts against the outer peripheral surface of the heat roller 46. The thermistor 51 detects the temperature of the outer peripheral surface of the heat roller 46. The temperature of the outer peripheral surface of the heat roller 46 detected by the thermistor 51 is used to control the temperature control of the heat roller 46 in the fixing device 36.

The thermistor 52 abuts against the outer peripheral surface of the fixing belt 47 wrapped around the belt heat roller 49. The thermistor 52 detects the temperature of the outer peripheral surface of the fixing belt 47. The temperature of the outer peripheral surface of the fixing belt 47 detected by the thermistor 52 is used for temperature control of the belt heat roller 49 in the fixing device 36.

Between the driving roller 31 and the secondary transfer roller 33 and the fixing device 36, a first guide member 62 and a second guide member 63 are arranged as the guide member 61. The guide members 62 and 63 are arranged between the transfer exit Q1 and the entrance Q2 of the nip N. The first guide member 62 and the second guide member 63 are arranged in the order from the upstream side towards the downstream side of the conveyance path 6.

The first guide member 62 has a main body 62*a* and a guide plate 62*b*. The main body 62*a* is fixed to the main body 11 of the image forming apparatus 1. The guide plate 62*b* is provided at the edge of the main body 62*a* to guide the sheet P.

The second guide member 63 has a main body 63*a*, a first guide plate 63*b*, and a second guide plate 63*c*. The main body 63*a* is fixed to the main body 11. The guide plates 63*b* and 63*c* are provided at the edge of the main body 63*a* to guide the sheet P.

The guide members 62 and 63 are not arranged on a reference line L1 connecting the transfer exit Q1 and the entrance Q2 of the nip N. The guide members 62 and 63 are arranged at one side of the reference line L1. For example, one side is a direction away from the heat roller 46 with respect to the reference line L1.

The guide plates 63*b* and 63*c* are arranged so as to be recessed toward one side with respect to the reference line L1.

The constitution of the controller 71 of the image forming apparatus 1 is described.

Figure 4:
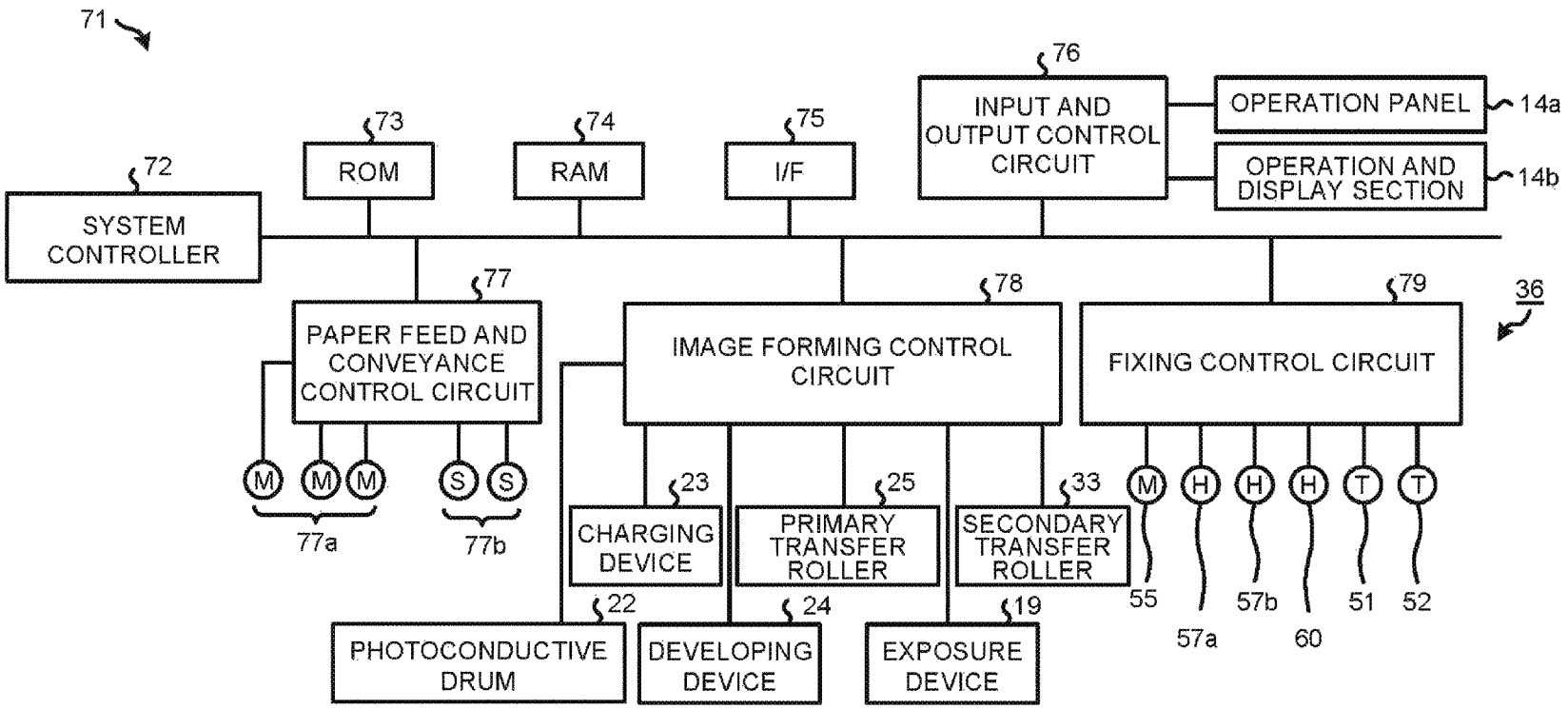
FIG. 4 is a block diagram exemplifying the constitution of a controller of the image forming apparatus according to the embodiment.

FIG. 4 is a block diagram exemplifying the constitution of the controller 71 of the image forming apparatus 1. However, in FIG. 4, for ease of view, the members distinguished by the subscripts Y, M, C, and K are represented collectively by reference numerals from which these subscripts are deleted. For example, the photoconductive drum 22 represents the photoconductive drums 22Y, 22M, 22C and 22K. The charging device 23, the developing device 24, and the primary transfer roller 25 are also similar.

In the description with reference to FIG. 4, based on the description in FIG. 4, the reference numerals with the subscripts Y, M, C and K omitted is used in some cases.

As shown in FIG. 4, the controller 71 includes a system controller 72, a read only memory (ROM) 73, a random access memory (RAM) 74, an interface (I/F) 75, an input and output control circuit 76, a sheet feed and conveyance control circuit 77, an image forming control circuit 78, and a fixing control circuit 79.

The system controller 72 controls the whole of the image forming apparatus 1. The system controller 72 realizes a processing function for image formation by executing a program stored in the ROM 73 or the RAM 74 described later.

As the device configuration of the system controller 72, a processor such as a CPU or the like may be used.

For example, the system controller 72 includes a plain sheet print mode and a thick sheet print mode as sheet control modes corresponding to the type of the sheet P to be printed (the basis weight of the sheet P). If the sheet control mode is the plain sheet print mode, the system controller 72 does not make the linear velocity of the heat roller 46 faster than the first linear velocity at which the driving roller 31 conveys the sheet P. On the other hand, if the sheet control mode is the thick sheet print mode, the system controller 72 executes a sheet acceleration and deceleration control to set the linear velocity of the heat roller 46 to a second linear velocity faster than the first linear velocity from the first linear velocity linear velocity as described later and then to the first linear velocity again.

In the present embodiment, a value of 106 g/m$^2$ is stored as a basis weight threshold value in the ROM 73 of the controller 71 described later. If the type of the sheet P is the thick sheet 1, the thick sheet 2, or the thick sheet 3 with a basis weight thereof equal to or greater than the basis weight threshold value, the sheet control mode becomes the thick sheet print mode, and the system controller 72 executes the sheet acceleration and deceleration control. If the type of the sheet P is a sheet with a basis weight less than the basis weight threshold value, the sheet control mode becomes the plain sheet print mode and the system controller 72 does not execute the sheet acceleration and deceleration control.

The system controller 72 is not limited to the condition for executing the sheet acceleration and deceleration control, and the system controller 72 may execute the sheet acceleration and deceleration control regardless of the type of the sheet P, and the sheet acceleration and deceleration control may be executed only if the sheet P is the thick sheet 2 and the thick sheet 3.

The system controller 72 has a toner print mode and a toner erasing mode as toner control modes depending on whether the toner is used for printing. If the toner control mode is the toner print mode, the printing is executed using any of the toner cartridges 28Y, 28M, 28C and 28K. On the other hand, no image formation is executed if the toner control mode is the toner erasing mode. In a decoloring toner erasing mode, used sheet P on which an image is formed with the decoloring toner is fed. The fixing temperature is set to a temperature at which the decoloring toner becomes transparent.

Depending on the sheet control mode and the toner control mode, the fixing temperature is appropriately set.

The ROM 73 stores the control program, control data, and the like that govern the basic operation of the image forming processing. The basis weight threshold value is stored in advance in the ROM 73 as the control data. For example, the basis weight threshold value is 106 g/m$^2$.

The RAM 74 is a working memory in the controller 71. For example, in the RAM 74, the control program or control data of the ROM 73 is loaded as necessary. Furthermore, the RAM 74 temporarily stores the image data sent from the input and output control circuit 76 or the data sent from the system controller 72.

For example, the sheet feed cassette 18A stores the plain sheet of A4 size and the sheet feed cassette 18B stores the thick sheet 2 of A4 size.

The I/F 75 communicates with a device connected to the main body 11. For example, the scanner section 15 is connected to the I/F 75 in a communicable manner. Furthermore, an external device can be connected to the I/F 75. As examples of the external device, a user terminal, a facsimile machine, and the like are exemplified.

The input and output control circuit 76 controls the operation panel 14*a* and the operation and display section 14*b*. The input and output control circuit 76 sends the operation input received from the operation panel 14*a* and the operation and display section 14*b* to the system controller 72.

The sheet feed and conveyance control circuit 77 controls a driving system included in the main body 11. For example, the driving system includes the sheet feed mechanisms 29A and 29B, the sheet feed rollers 35A and 35B, the manual sheet feed mechanism 29C, and the driving motor 77*a* driving the resist roller 41. More preferably, a plurality of the driving motors 77*a* is provided.

A plurality of sensors 77*b* is electrically connected to the sheet feed and conveyance control circuit 77. For example, the plurality of sensors 77*b* includes a plurality of sheet detection sensors. A plurality of the sheet detection sensors are arranged inside the conveyance path 6 in the main body 11, or inside the sheet feed cassettes 18A and 18B and the manual sheet feed unit 18C. Each of the sheet detection sensors detects the presence or absence of the sheet P at the arrangement position thereof.

The detection output of each sensor 77*b* is sent from the sheet feed and conveyance control circuit 77 to the system controller 72.

The seat feed and conveyance control circuit 77 controls the driving motor 77*a* based on a control signal from the system controller 72 and a detection output from the sensor 77*b*.

Based on the control signal from the system controller 72, the image forming control circuit 78 controls the photoconductive drum 22, the charging device 23, the exposure device 19, the developing device 24, the primary transfer roller 25, and the secondary transfer roller 33, respectively.

The fixing control circuit 79 controls the driving motor 55, the halogen lamps 57*a*, 57*b* and 60 of the fixing device 36 based on the control signal from the system controller 72.

The thermistors 51 and 52 are electrically connected to the fixing control circuit 79. The thermistors 51 and 52 send the information on the temperature of the heat roller 46 and the fixing belt 47 respectively to the fixing control circuit 79.

The fixing control circuit 79 executes a lighting control of the halogen lamps 57*a*, 57*b* and 60 based on the control signal from the system controller 72 and the information on the temperature by the thermistors 51 and 52.

The detail of the control executed by the controller 71 is described together with the operation of the image forming apparatus 1.

Figure 5:
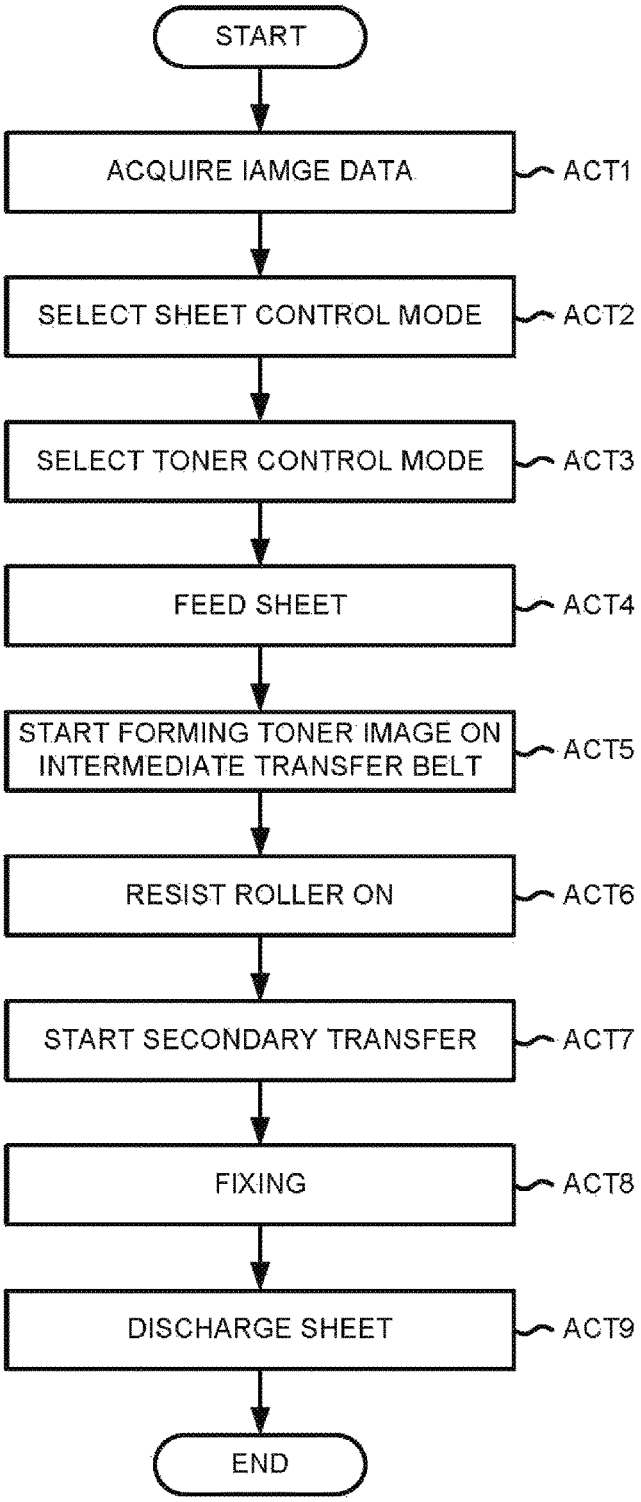
FIG. 5 is a flowchart exemplifying the operation at the time of printing by the image forming apparatus according to the embodiment.

The operation of the image forming apparatus 1 of the present embodiment is described. FIG. 5 is a flowchart exemplifying the operation at the time of printing by the image forming apparatus 1 according to the embodiment.

The image forming apparatus 1 prints an image on the sheet P by executing the processing in ACT 1 to ACT 9 shown in FIG. 5 according to a flow shown in FIG. 5.

In ACT 1, the image forming apparatus 1 reads the image data. For example, acquisition of the image data may be executed by enabling the scanner section 15 to read the original document. In this case, an operator places the original document on the document table 12 or the ADF 13. Thereafter, the operator inputs a scan start operation of the scanner section 15 through the operation section 14. The image data read by the scanner section 15 is stored in the RAM 74 via the I/F 75.

For example, the image data may be acquired from an external device connected to the image forming apparatus 1 via the I/F 75. The image data read from the external device is stored in the RAM 74.

The image data includes print setting information. The information of the print setting includes at least information on the size of the sheet P, a printing orientation and the number of printed sheets for printing the image data. If the image data is acquired from the scanner section 15, the information on the size of the sheet P, the printing orientation and the number of printed sheets is information obtained by reading the original document by the scanner section 15 or preset information by the operation section 14.

For example, a case in which the image data is read from the scanner section 15 is described below. For example, the operator enables an original document of an A4 size to be read.

After the image data is read, the processing in ACT 1 is finished, the processing in ACT 2 is executed.

In ACT 2, the operator selects the sheet control mode by operating the operation section 14. In the following, as an example, a case in which the operator selects the sheet P which is the thick sheet 2 is described. In this case, the sheet control mode automatically becomes the thick sheet print mode.

Figure 6:
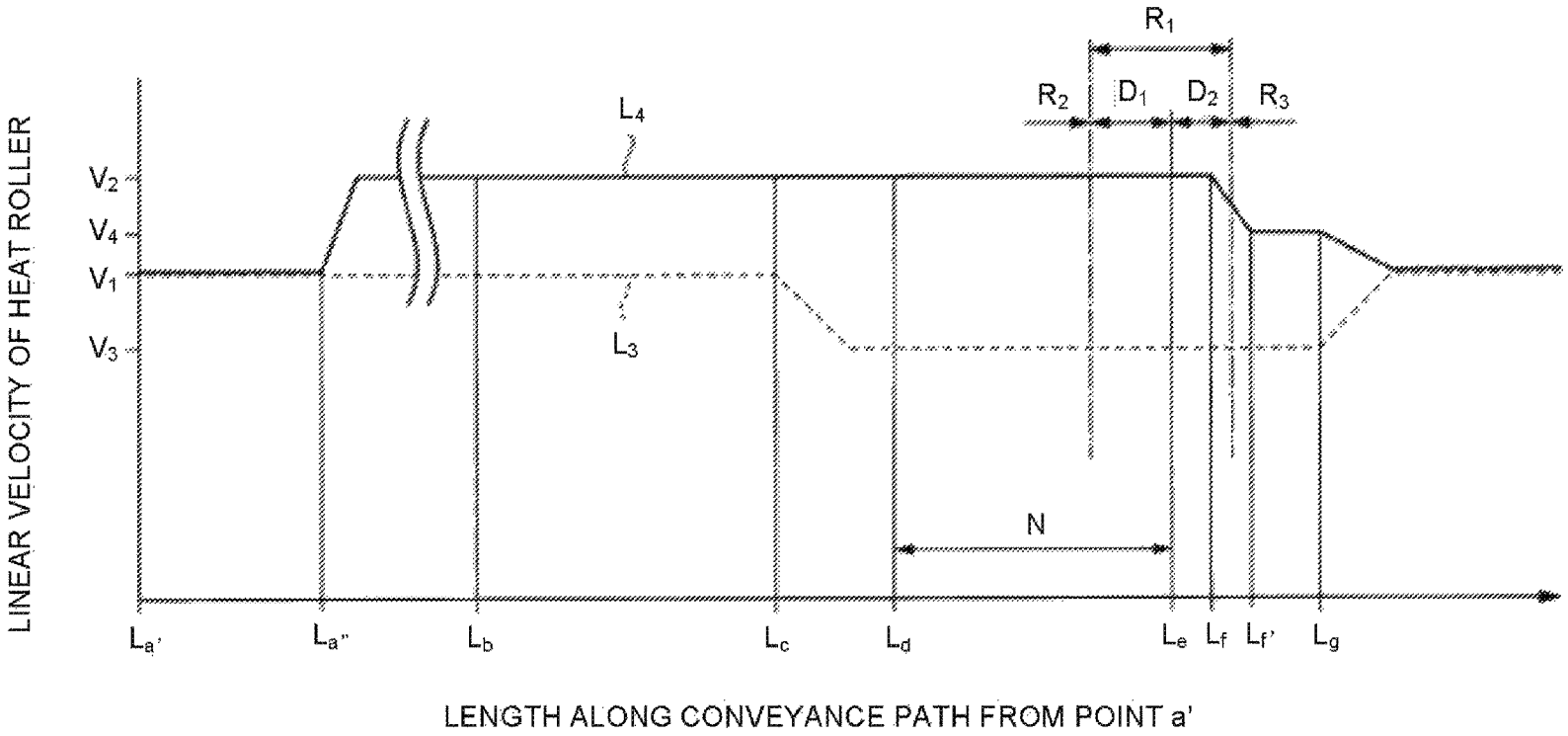
FIG. 6 is a schematic diagram illustrating an example of a relationship between a position of a tip of a sheet and change in a linear velocity of a heat roller in the image forming apparatus according to the embodiment.

The linear velocities of the heat roller 46 in the plain sheet print mode and in the thick sheet print mode are described. In FIG. 6, a horizontal axis represents a length along the conveyance path 6 from the point a' described later, and a vertical axis represents a linear velocity of the heat roller 46. A polygonal line L3 indicated by a dotted line represents the linear velocity of the heat roller 46 if the sheet control mode is the plain sheet print mode and a polygonal line L4 indicated by a solid line represents the linear velocity of the heat roller 46 if the sheet control mode is the thick sheet print mode. The relationship between the position of the end of the downstream side (the end of the sheet P) of the sheet P in the conveyance direction and the linear velocity of the heat roller in polygonal lines L3 and L4 shows a correspondence relationship if the sheet P is conveyed along the ideal conveyance path 6.

The point a' is an arbitrary position which is not particularly limited as long as it is between the sheet feed cassettes 18A and 18B or the manual sheet feed unit 18C and the point b which is the secondary transfer position b. The point a' may be the resist position a. A length La' along the conveyance path 6 from the point a' to the point a' on the horizontal axis in FIG. 6 becomes 0. The linear velocity of the heat roller 46 if the tip of the sheet P is located at the point a' is the first linear velocity V1 in both the plain sheet print mode and the thick sheet print mode.

Lengths Lb, Lc, Ld, Le, Lf and Lg in the horizontal axis in FIG. 6 are lengths along the length along conveyance path 6 from the point a' which correspond to the positions of the points b, c, d, e, f and g in FIG. 3.

As shown in FIG. 3, the point d is equivalent to the same position (including matching position) as the entrance Q2 of the nip N.

The point c is located on the conveyance path 6 on the design between the second guide member 63 and the point d. A path length cd (difference between the length Ld and the length Lc) is set to a length greater than a conveyance position variation of the sheet P in the vicinity of the point d.

The point e is the same position (including the matching position) as the exit Q3 of the nip N. (Le-Ld) is a size of the nip width.

The point g is positioned on the conveyance path 6 between the point e and the conveyance roller 37 (refer to FIG. 1). For example, a path length eg is more than 0 mm and equal to or smaller than 10 mm.

The point f is located on the conveyance path 6 between the point e and the point g.

If the sheet control mode is the plain sheet print mode, the linear velocity of the heat roller 46 maintains at the first linear velocity V1 by the point c as indicated by the polygonal line L3 in FIG. 6. The linear velocity of the heat roller 46 begins to decelerate at the point c and becomes a third linear velocity V3 slower than the first linear velocity V1 by the point g. Thereafter, the linear velocity of the heat roller 46 maintains at the third linear velocity V3 by the point g. The linear velocity of the heat roller 46 begins to accelerate at the point g and becomes the first linear velocity V1.

On the other hand, if the sheet control mode is the thick sheet print mode, as indicated by the polygonal line L 4, the linear velocity of the heat roller 46 starts acceleration at a point a" on the conveyance path 6 between points a' and b to become the second linear velocity V2 faster than the first linear velocity V1. The linear velocity of the heat roller 46 becomes the second linear velocity V2 before reaching the point b which is the secondary transfer position b. Thereafter, the linear velocity of the heat roller 46 maintains the second linear velocity V2 by the point f.

The position of the point f may be a position moved in a predetermined range from the point e to the upstream side and the downstream side along the conveyance path 6. It is preferable that a path length ef (difference between the length Le and the length Lf) from the point e shown in FIG. 6 to the upstream side is equal to or smaller than 3.0 mm which is a first length threshold value D1. The path length ef to the upstream side is preferably equal to or less than 2.5 mm, and more preferably equal to or less than 2.0 mm. On the other hand, the path length ef to the downstream side is preferably equal to or smaller than 5.0 mm which is a second length threshold value D2. The path length ef to the downstream side is preferably equal to or less than 2.5 mm, and more preferably equal to or less than 2.0 mm.

In this manner, a settable range (predetermined range) R1 of the point f is a range from the position of 3.0 mm to the upstream side from the point e to the position of 5.0 mm to the downstream side. The settable range R includes the point e which is the exit Q3 of the nip N.

The ratio of the second linear velocity V2 to the first linear velocity V1 is equal to or greater than 1.02 and equal to or smaller than 1.10, and preferably equal to or greater than 1.05 and equal to or smaller than 1.08.

The linear velocity of the heat roller 46 starts decelerating from the second linear velocity V2 if the tip of the sheet P reaches the point f. The linear velocity of the heat roller 46 is lowered to a fourth linear velocity V4 which is higher than the first linear velocity V1 and slower than the second linear velocity V2 at a point f' on the conveyance path 6 between the point f and the point g. The linear velocity of the heat roller 46 maintains the fourth linear velocity V4 between the point f' and the point g. The linear velocity of the heat roller 46 begins to decelerate at the point g to become the first linear velocity V1. The linear velocity of the heat roller 46 is decelerated in two stages.

The linear velocity of the heat roller 46 may be reduced in one step without providing the point f' on the conveyance path 6.

Returning to the operation description of the image forming apparatus 1, for the sake of simplicity, a case in which the sheet P that matches the type of the sheet P selected by the operator is accommodated in the sheet feed cassettes 18A and 18B is described. If the sheet P matching the type of the sheet P selected by the operator does not exist in the sheet feed cassettes 18A and 18B, the system controller 72 sends a warning message to the operation and display section 14*b* and the external device. The system controller 72 urges the operator to reselect the type of the sheet P.

Through the above, the processing in ACT 2 is end.

If the processing in ACT 2 ends, the processing in ACT 3 is executed. In ACT 3, the operator selects the toner control mode by operating the operation section 14. As an example, a case in which the operator selects the toner print mode is described.

The system controller 72 sends a control signal to the fixing control circuit 79 to start a warm-up operation of the fixing device 36 based on the selected control mode. The fixing control circuit 79 starts the warm-up operation of the fixing device 36.

The fixing control circuit 79 lights at least one of the halogen lamps 57*a* and 57*b*, and the halogen lamp 60. The fixing control circuit 79 monitors the detection output of the thermistors 51 and 52, and controls the heat roller 46 and the fixing belt 47 to become the predetermined fixing temperature. The fixing control circuit 79 detects the end of the warm-up operation by the detection output of the thermistors 51 and 52.

In a case of the completion of the warm-up operation, the fixing control circuit 79 sends a conveyance permission signal of the sheet P to the system controller 72.

If the selection of the toner control mode is completed, the processing in ACT 3 ends.

If the processing in ACT 3 ends, the processing in ACT 4 is executed. In ACT 4, the sheet P selected in ACT 2 is fed. More specifically, the system controller 72 sends the control signal to the sheet feed and conveyance control circuit 77 to start sheet feeding of the sheet P. Based on the control signal from the system controller 72, the sheet feed and conveyance control circuit 77 controls to supply the sheet P from the sheet feed cassette 18B accommodating the sheet P which is the thick sheet 2 of the selected A4 size. Specifically, the sheet feed mechanism 29B is driven. In addition, the sheet feed and conveyance control circuit 77 drives the sheet feed rollers 35A and 35B in the conveyance path 6 by the resist roller 41. The linear velocity of the heat roller 46 at this time is the first linear velocity V1.

The sheet P is stopped with the tip of the sheet P abutting against the resist roller 41 at the secondary transfer position b.

Through the above, the processing in ACT 4 is end.

The processing in ACT 5 is executed after ACT 4. In ACT 5, formation of the toner image on the intermediate transfer belt is started. Specifically, the system controller 72 determines whether the conveyance permission signal is received from the fixing control circuit 79. If the conveyance permission signal is received, the system controller 72 sends the control signal to start forming the toner image to the sheet feed and conveyance control circuit 77, the image forming control circuit 78, and the fixing control circuit 79.

The sheet feed and conveyance control circuit 77, the image forming control circuit 78, and the fixing control circuit 79 start the control operation at the same time, respectively.

Through the above, the processing in ACT 5 is end.

The image forming control circuit 78 starts the image forming processes of the image forming sections 20Y, 20M, 20C and 20K in this order. In each of the image forming sections 20Y, 20M, 20C and 20K, the electrostatic latent images are written on the surfaces of the photoconductive drums 22Y, 22M, 22C and 22K by the exposure light LY, LM, LC and LK from the exposure device 19. Each electrostatic latent image is developed by the developing device 24Y, 24M, 24C and 24K.

The developed toner image is primarily transferred onto the intermediate transfer belt 21 by the primary transfer rollers 25Y, 25M, 25C and 25K. Each toner image forming region overlaps with each other by each primary transfer. Each of the toner images stacked on the intermediate transfer belt 21 is conveyed toward the secondary transfer position b by the intermediate transfer belt 21.

Along with the operation of the image forming control circuit 78, the processing in ACT 6 is executed. In ACT 6, at the timing the toner image reaches a predetermined position, the driving motor 77*a* driving the resist roller 41 is driven by the sheet feed and conveyance control circuit 77. The rotation of the resist roller 41 is started by the driving motor 77*a*. The timing to start the rotation of the resist roller 41 is the timing at which the tip of the toner image transfer area on the sheet P reaches the secondary transfer position b if the tip of the toner image reaches the secondary transfer position b. The resist roller 41 rotates at the first linear velocity V1.

The linear velocity of the heat roller 46 begins to accelerate from the first linear velocity V1 at the point a" by the sheet feed and conveyance control circuit 77 to become the second linear velocity V2 faster than the first linear velocity V1. The linear velocity of the heat roller 46 becomes the second linear velocity V2 before the tip of the sheet P reaches the nip N.

After this, the resist roller 41 is rotated to keep the first linear velocity V1 until the tip of the sheet P reaches the point g. Thereafter, the rotation of the resist roller 41 is stopped.

Through the above, the processing in ACT 6 is end.

If the processing in ACT 6 ends and the tip of the sheet P reaches the secondary transfer position b, the processing in ACT 7 is executed.

In ACT 7, the toner image on the intermediate transfer belt is secondarily transferred onto the sheet P. More specifically, the sheet feed and conveyance control circuit 77 rotates the driving roller 31 at the first linear velocity V1. The image forming control circuit 78 applies a secondary transfer voltage to the secondary transfer roller 33 during the time until the tip of the sheet Preaches the secondary transfer position b. The toner image is secondarily transferred onto the sheet P passing through the secondary transfer position b. The secondary transfer roller 33 rotates in the same velocity as the intermediate transfer belt 21 in the opposite direction. The sheet P is conveyed to the conveyance direction at the first linear velocity which is the process velocity during the execution of the secondary transfer. The sheet P passing through the secondary transfer position b is conveyed towards the fixing device 36 along the conveyance path 6.

The image forming control circuit 78 stops applying the secondary transfer voltage after the rear end of the sheet P passes through the secondary transfer position b.

If the sheet P passing through the secondary transfer position b enters the fixing device 36, the processing in ACT 8 is executed. In ACT 8, the fixing device 36 fixes the toner image on the sheet P.

As shown in FIG. 3, the sheet P enters between the heat roller 46 and the fixing belt 47 along the guide members 62 and 63. The sheet P is conveyed towards the fixing device 36 with little gap formed between the guide members 62 and 63 and the sheet P.

The fixing belt 47, the pressure roller 48, and the belt heat roller 49 rotate together at the second linear velocity V2 because the linear velocity of the heat roller 46 is the second linear velocity V2.

The nip N is heated to the fixing temperature according to the control mode.

The fixing control circuit 79 controls to change the linear velocity of the heat roller 46 according to the polygonal line L4 according to the position of the tip of the sheet P.

Figure 7:
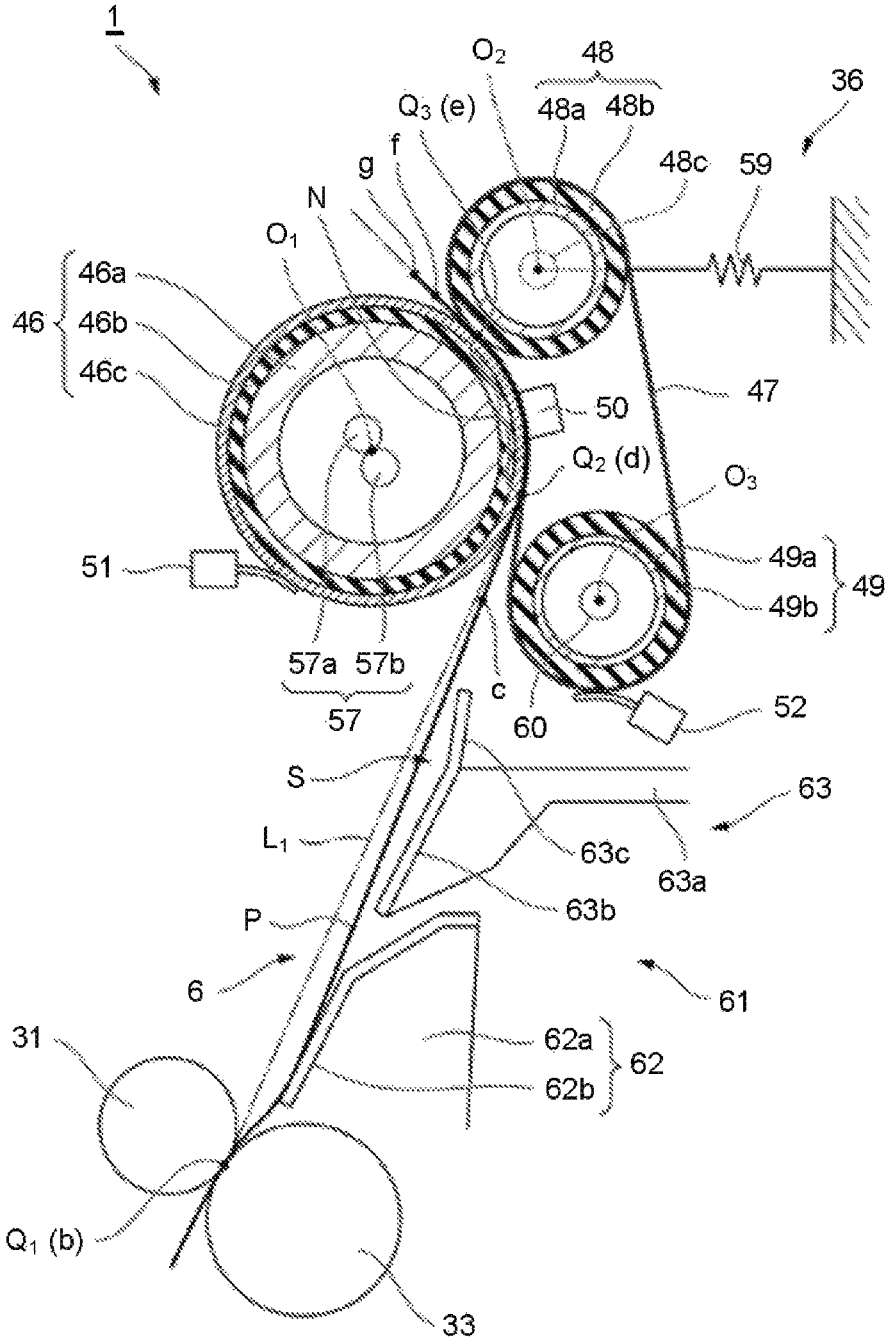
FIG. 7 is a schematic diagram of a cross section exemplifying the constitution of main sections of the fixing device to describe the operation of the image forming apparatus according to the embodiment.

If the tip of the sheet P reaches the entrance Q2 of the nip N, as the linear velocity of the heat roller 46 is faster than the linear velocity of the driving roller 31, as shown in FIG. 7, the sheet P extends along the reference line L1 and separates from the second guide member 63 to form a gap S between the sheet P and the second guide member 63. On the other hand, the nip N is curved if viewed along the central axis O1, and the sheet P is the thick sheet 2. As the relatively thick sheet P is hard to bend along the shape of the nip N, if the tip of the sheet P reaches the entrance Q2 of the nip N, there is a case in which the conveyance speed at the tip side of the sheet P is slower than the conveyance speed at a base end side of the sheet P. In this case, the fixing device 36 temporarily stops moving the sheet P.

Even in this case, since the gap S is formed between the sheet P and the second guide member 63, as shown in FIG. 3, the sheet P deforms to curve (bend) along the second guide member 63. In other words, the gap S is the deflection margin of the sheet P. As a result, the impact given to the tip side of the sheet P is transmitted to the base end side of the sheet P, and the toner image transferred onto the sheet P is suppressed from being deviated.

If a period in which the linear velocity of the heat roller 46 is higher than the linear velocity of the driving roller 31 continuously elapses, there is a possibility that the sheet P is drawn to the downstream side by the heat roller 46 and the toner image transferred onto the sheet P is blurred. In the present embodiment, it is possible to suppress the blur of the toner image caused by drawing the sheet P to the downstream side by the heat roller 46 by changing the linear velocity of the heat roller 46 from the second linear velocity V2 to the first linear velocity V1 in the sheet acceleration and deceleration control.

In FIG. 6, it is assumed that the point f is contained in a range R2 at the upstream side of the position moved by the first length threshold value D1 to the upstream side along the conveyance path 6 around the position of the point e. If the linear velocity of the heat roller 46 begins to decelerate from the point f, there is a possibility of shrinking the toner image transferred on to the sheet P in the conveyance direction. On the other hand, it is assumed that the point f falls within a range R3 at the downstream side of the position advanced by the second length threshold value D2 to the downstream side along the conveyance path 6 around the position of the point e. If the linear velocity of the heat roller 46 begins to decelerate from the point f, there is a possibility of extending the toner image transferred onto the sheet P in the conveyance direction.

Through the above, the processing in ACT 8 is end.

After the processing in ACT 8, the processing in ACT 9 is executed.

In ACT 9, the sheet P is discharged. The sheet P discharged from the fixing device 36 reaches the conveyance roller 37. The conveyance roller 37 discharges the sheet P to the sheet discharge section 38.

Through the above, the image formation on one sheet P ends. In ACT 2, if the operator selects the sheet P which is the plain sheet, the sheet control mode automatically inputs the plain sheet print mode.

In this case, in ACT 4, the sheet feed and conveyance control circuit 77 controls to feed the sheet P from the sheet feed cassette 18A housing the sheet P which is the plain sheet of the selected A4 size based on the control signal from the system controller 72. Specifically, the sheet feed mechanism 29A is driven.

In ACT 8, the fixing control circuit 79 controls to change the linear velocity of the heat roller 46 along the polygonal line L3 according to the position of the tip of the sheet P.

As described above, according to the image forming apparatus 1 of the present embodiment, the system controller 72 executes the sheet acceleration and deceleration control. As a result, as the sheet P extends along the reference line L1, even if the sheet P temporarily stops moving in the fixing device 36, the sheet P bends, and the impact on the tip side of the sheet P is transmitted to the base end side of the sheet P and the toner image transferred onto the sheet P can be prevented from being deviated.

The guide member 61 is arranged at one side of the reference line L1. If the sheet P extends along the reference line L1, the gap S is formed between the sheet P and the guide member 61. In this way, the toner image transferred onto the sheet P can be prevented from being deviated at the time the movement of the sheet P temporarily stops at the fixing device 36 and the conveyed sheet P can be guided with the guide member 61 at the time the sheet P is conveyed.

The controller 71 executes the sheet acceleration and deceleration control if the basis weight of the sheet P is equal to or greater than the basis weight threshold value. The sheet acceleration and deceleration control is not necessary because the sheet P is relatively easy to bend along the shape of the nip N if the basis weight of the sheet P is less than the basis weight threshold value.

If the supply section 28 supplies the printer section 17 with the decoloring toner, the nip width is required to be relatively long to ensure the heating length to erase the color of the decoloring toner. In the case in which the nip width is long, the fixing device 36 stops the movement of the sheet P temporarily. Even in such a case, by executing the sheet acceleration and deceleration control of the present embodiment, it is possible to prevent the toner image transferred onto the sheet P from being blurred.

An experiment is conducted on a point f at which the linear velocity of the heat roller 46 begins to decelerate, and the results examined in more detail is described. R is set to the ratio of the second linear velocity V2 to the first linear velocity V1.

Figure 8:
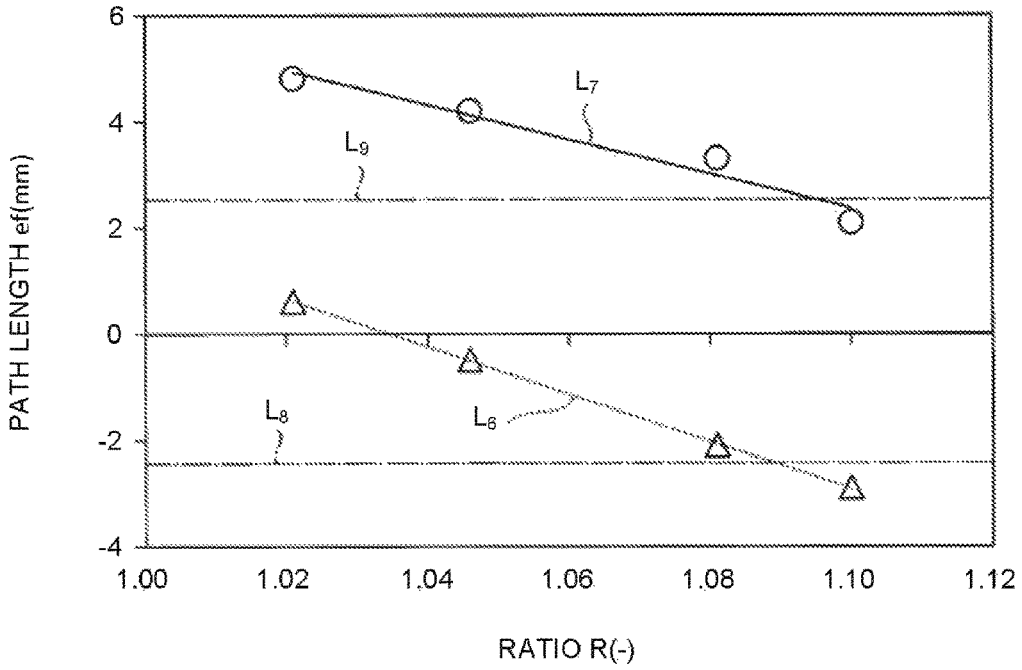
FIG. 8 is a diagram illustrating a preferable range as a path length with respect to a ratio of the linear velocities of the image forming apparatus according to the embodiment.

If the ratio R is small, as in the case in which the point f enters the range R2, the toner image transferred onto the sheet P is shrank in the conveyance direction in some cases. On the other hand, if the ratio R is small, there is a possibility of extending the toner image transferred onto the sheet P in the conveyance direction, as in the case in which the point f enters the range R3. For the ratio R, the preferable range as the path length ef is shown in FIG. 8. In FIG. 8, the path length ef is expressed by setting the downstream side as a positive value and the upstream side as a negative value. In other words, the path length ef is the length along the conveyance path 6 with respect to to the exit Q3 of the nip N by setting the downstream side to be positive. The test result indicated by mark A in FIG. 8 shows the position of the upstream side end along the conveyance path 6 of the settable range R1 where the toner image is hard to blur with respect to the ratio R. A mark ○ in FIG. 8 indicates the position of the downstream side end along the conveyance path 6 of the settable range R1 where the toner image is hard to blur with respect to the ratio R.

An approximate straight line L6 according to a primary equation of the test result indicated by mark A is expressed by Equation (1) by setting a length corresponding to a movement amount to the downstream side along the conveyance path 6 with respect to the exit Q3 of the nip N to M1 (mm).

$$M1=-44.5R+46.1 \quad (1)$$

On the other hand, an approximate straight line L7 according to the primary equation of the test result indicated by the mark ○ is expressed by Equation (2) by setting a length corresponding to a movement amount to the downstream side along the conveyance path 6 with respect to the exit Q3 of the nip N to M2 (mm).

$$M2=-32.5R+38.1 \quad (2)$$

Lines L8 and L9 corresponding to the positions where the path length of is 2.5 mm are shown in FIG. 8.

By setting the position of the point f from the position moving by the length M1 to the downstream side along the conveyance path 6 with respect to the exit Q3 of the nip N to the position moving by the length M2, it is possible to more reliably suppress the toner image transferred onto the sheet P from being blurred according to the ratio R.

In the present embodiment, it is considered that the sheet P does not interfere with the members constituting the image forming apparatus 1 if the sheet P bends temporarily because the fixing device 36 temporarily stops the movement of the sheet P. In this case, the image forming apparatus 1 may not include the guide member 61.

In the fixing device 36, the second rotating body is the belt 47. However, the second rotating body may be a roller, or the fixing device may not have the belt.

Each of the sheet feed cassettes 18A and 18B and the manual sheet feed unit 18C may have a basis weight sensor that detects the basis weight of the sheet P. For example, in this case, if the operator selects one of the sheet feed cassettes 18A and 18B and the manual sheet feed unit 18C by operating the operation section 14, the basis weight sensor of the selected one of the sheet feed cassettes 18A and 18B and the manual sheet feed unit 18C detects the basis weight of the sheet P. The sheet control mode may be switched automatically based on the detected basis weight of the sheet P.

According to at least one embodiment described, even though the movement of the sheet P temporarily stops at the fuser 36 by having the controller 71, that the toner image transferred onto the sheet P is blurred can be suppressed.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a transfer section, including a transfer rotating body for conveying a sheet at a first linear velocity, configured to transfer a toner image onto the sheet;

a fixing section including a first rotating body, a second rotating body facing the first rotating body to form a nip sandwiching the sheet with the first rotating body, and a heating section for heating the sheet onto which the toner image is transferred; and a controller configured to execute a sheet acceleration and deceleration control for setting the first rotating body to a second linear velocity from the first linear velocity before a front tip of the sheet reaches the nip, the second linear velocity higher than the first linear velocity, and decelerating the first rotating body from the second linear velocity to the first linear velocity at the time the front tip of the sheet reaches a predetermined range in a sheet conveyance path including an exit of the nip.

2. The image forming apparatus according to claim 1, further comprising:

a guide member arranged at one side of a reference line connecting a transfer exit and an entrance of the nip and between the transfer exit at which the transfer rotating body conveys the sheet in the conveyance path and the entrance of the nip, the guide member configured to guide the sheet.

3. The image forming apparatus according to claim 1, wherein the controller executes the sheet acceleration and deceleration control at a time a basis weight of the sheet is equal to or greater than a predetermined basis weight threshold value.

4. The image forming apparatus according to claim 2, wherein the controller executes the sheet acceleration and deceleration control at a time a basis weight of the sheet is equal to or greater than a predetermined basis weight threshold value.

5. The image forming apparatus according to claim 1, wherein an upstream end along the sheet conveyance path of the predetermined range is at a position of moving by a length M1 (mm) by Equation (1) to a downstream side along the conveyance path with respect to an exit of the nip, and a downstream end along the sheet conveyance path of the predetermined range is at a position of moving by a length M2 (mm) by Equation (2) to the downstream side along the sheet conveyance path with respect to the exit of the nip at the time a ratio of the second linear velocity to the first linear velocity is set to R, $$M1=-44.5R+46.1 \quad (1)$$

$$M2=-32.5R+38.1 \quad (2).$$

6. The image forming apparatus according to claim 1, further comprising:

a supply section configured to supply a decoloring toner to the transfer section.

7. The image forming apparatus according to claim 1, further comprising:

a printer section comprising two or more image forming sections.

8. The image forming apparatus according to claim 1, further comprising:

a printer section comprising three or more image forming sections arranged in parallel.

9. An image forming method, comprising:

transferring a toner image onto a sheet;

conveying the sheet using a transfer rotating body at a first linear velocity to a nip formed between a first rotating body and a second rotating body;

heating the sheet onto which the toner image is transferred;

accelerating the first rotating body to a second linear velocity from the first linear velocity before a front tip of the sheet reaches the nip, the second linear velocity higher than the first linear velocity; and decelerating the first rotating body from the second linear velocity to the first linear velocity at a time the front tip of the sheet reaches a predetermined range in a sheet conveyance path.

10. The image forming method according to claim 9, further comprising:

guiding the sheet to the nip using a guide member.

11. The image forming method according to claim 9, wherein accelerating and decelerating at a time a basis weight of the sheet is equal to or greater than a predetermined basis weight threshold value.

12. The image forming method according to claim 10, wherein accelerating and decelerating at a time a basis weight of the sheet is equal to or greater than a predetermined basis weight threshold value.

13. The image forming method according to claim 9, wherein an upstream end along the sheet conveyance path of the predetermined range is at a position of moving by a length M1 (mm) by Equation (1) to a downstream side along the sheet conveyance path with respect to an exit of the nip, and a downstream end along the sheet conveyance path of the predetermined range is at a position of moving by a length M2 (mm) by Equation (2) to the downstream side along the sheet conveyance path with respect to the exit of the nip at the time a ratio of the second linear velocity to the first linear velocity is set to R, $$M1=-44.5R+46.1 \quad (1)$$

$$M2=-32.5R+38.1 \quad (2).$$

14. The image forming method according to claim 9, wherein a ratio of the second linear velocity V2 to the first linear velocity V1 is equal to or greater than 1.02 and equal to or smaller than 1.10.

15. The image forming method according to claim 9, wherein a ratio of the second linear velocity V2 to the first linear velocity V1 is equal to or greater than 1.05 and equal to or smaller than 1.08.

16. A method of reducing blur in a toner image on a sheet, comprising:

conveying the sheet having the toner image using a transfer rotating body at a first linear velocity to a nip formed between a first rotating body and a second rotating body;

heating the sheet having the toner image;

accelerating the first rotating body to a second linear velocity from the first linear velocity before a front tip of the sheet reaches the nip, the second linear velocity higher than the first linear velocity; and decelerating the first rotating body from the second linear velocity to the first linear velocity at a time the front tip of the sheet reaches a predetermined range in a sheet conveyance path.

17. The method of reducing blur according to claim 16, wherein accelerating and decelerating at a time a basis weight of the sheet is equal to or greater than a predetermined basis weight threshold value.

18. The method of reducing blur according to claim 16, wherein an upstream end along the sheet conveyance path of the predetermined range is at a position of moving by a length M1 (mm) by Equation (1) to a downstream side along the sheet conveyance path with respect to an exit of the nip, and a downstream end along the sheet conveyance path of the predetermined range is at a position of moving by a length M2 (mm) by Equation (2) to the downstream side along the sheet conveyance path with respect to the exit of the nip at the time a ratio of the second linear velocity to the first linear velocity is set to R, $$M1=-44.5R+46.1 \quad (1)$$

$$M2=-32.5R+38.1 \quad (2).$$

19. The method of reducing blur according to claim 16, wherein a ratio of the second linear velocity V2 to the first linear velocity V1 is equal to or greater than 1.02 and equal to or smaller than 1.10.

20. The method of reducing blur according to claim 16, wherein a ratio of the second linear velocity V2 to the first linear velocity V1 is equal to or greater than 1.05 and equal to or smaller than 1.08.

* * * * *